US005497824A

United States Patent [19]

Rouf

[11] Patent Number: 5,497,824

[45] Date of Patent: Mar. 12, 1996

[54] METHOD OF IMPROVED HEAT TRANSFER

[76] Inventor: Mohammad A. Rouf, 12 Sierra Dr., Glen Carbon, Ill. 62034

[21] Appl. No.: 288,558

[22] Filed: Aug. 10, 1994

Related U.S. Application Data

[63] Continuation of Ser. No. 466,861, Jan. 18, 1990, abandoned.

[51] Int. Cl.[6] ..... F28F 13/02

[52] U.S. Cl. ..... 165/1; 165/184; 165/109.1; 138/38

[58] Field of Search ..... 165/109.1, 184, 165/1; 138/38

[56] References Cited

U.S. PATENT DOCUMENTS

| | | | |
|---|---|---|---|
| 1,246,583 | 11/1917 | Fulweiler | 138/38 |
| 2,220,726 | 11/1940 | Newcum | 165/179 X |
| 4,009,751 | 3/1977 | Zelnik | 165/1 |
| 4,798,241 | 1/1989 | Jarrett et al. | 165/109.1 |

FOREIGN PATENT DOCUMENTS

| | | | |
|---|---|---|---|
| 664018 | 5/1979 | U.S.S.R. | 138/38 |
| 705239 | 1/1980 | U.S.S.R. | 138/38 |
| 1453147A | 1/1989 | U.S.S.R. | 165/109.1 |
| 984156 | 2/1965 | United Kingdom | 165/109.1 |

*Primary Examiner*—Allen J. Flanigan
*Attorney, Agent, or Firm*—Heller & Kepler

[57] ABSTRACT

An improved method of heat transfer between a first substantially homogenous fluid passing through the inside of a heat exchange tube, and a second fluid on the outside of the heat exchange tube includes the step of passing the first fluid through a compound turbulator inside the tube. The compound turbulator includes a twisted strip surrounded by a helical coil that is closely spaced from the walls of the tube. Passing the first fluid over the compound turbulator generates a high level of turbulence in the first fluid in the region adjacent the tube wall, facilitating heat transfer to the second fluid on the outside of the heat exchange tube. The augmentation of heat transfer to the second fluid can also be accomplished through the use of a helical coil installed on the outside of the tube.

10 Claims, 2 Drawing Sheets

METHOD OF IMPROVED HEAT TRANSFER

This application is a continuation of application Ser. No. 466,861, filed Jan. 18, 1990, now abandoned.

BACKGROUND OF THE INVENTION

This invention relates to a improved method of heat exchange between a first fluid inside a heat exchange tube and a second fluid on the outside of the heat exchange tube.

When heat is transferred from one fluid to another fluid through a solid wall (e.g., the wall of the tube) the magnitude of heat transfer depends on (a) surface area, (b) the value of heat transfer coefficient at the inside and outside surface of the tube, (c) the thermal conductivity of the tube wall material, (d) the wall thickness, and (e) temperatures of the participating fluid. Therefore, for given fluids and their temperatures and for a given tube material and size, the magnitude of heat transfer can be significantly increased by augmenting heat transfer at the inside or outside or on both sides of the tube wall. Such augmentation is defined as the improvement of the convective heat transfer coefficient. Therefore, the method of this invention is useful in economizing design and manufacture of a large variety of heat exchange equipment by reducing the heat transfer surface for given magnitude of heat transfer. However the method of this invention is simple enough to implement in new or existing heat transfer equipment and economical enough to justify its cost compared with the benefits it can derive.

A turbulator can most effectively improve heat transfer if it is capable of generating a high level of turbulence in the boundary layer very close to the wall surface. The turbulators that are presently available in the market do not effectively generate such high levels of turbulence close to the wall surface through which heat transfer actually takes place. For example, the turbulators disclosed in Smick, U.S. Pat. No. 4,044,796, and Burke, U.S. Pat. No. 4,412,558, are both made of a metal strip of suitable width formed in a zigzag shape. When such turbulators are placed inside a tube, a portion of the tube opening is blocked and, therefore, the fluid has to flow around the turbulator strip. As the fluid passes over the strip, turbulence is generated primarily in the bulk fluid due to flow separation. The turbulence thus created eventually transmits into the boundary layer where the viscosity of the fluid dampens down the intensity of the turbulence, meaning reduced effectiveness in the augmentation of heat transfer. Moreover, the zigzag strip is limited for the tube's internal augmentation and it is not suitable for liquids, especially for viscous liquids due to the high pressure drop and reduced effectiveness.

Another kind of turbulator presently available in the market is known as a spinner turbulator, comprises a twisted metal strip. It is inserted inside a tube. It is used for both liquid and gas. As the flow progresses through the tube, the fluid gains spinning motion as it follows the contoured path of the twisted strip and thereby exerts centrifugal force on the tube wall and partially distorts the boundary layer. Also the combined effect of spinning and translatory motion of the fluid increases the turbulence level in the bulk fluid which eventually transmits into the boundary layer, but at a reduced intensity due to viscous effect of the fluid. Again, this type of turbulator is limited for insertion inside a tube.

The boundary layer turbulators used in the present invention are effective heat transfer augmenters Their primary function, unlike the other turbulators, is to generate a very high level of turbulence right in the boundary layer very close to the wall surface where heat transfer actually takes place. The turbulence thus generated propagates from the boundary layer to bulk fluid.

The comprised turbulator consists of a wire or ribbon coiled in the form of a helical spring placed inside the tube to extend the entire length of the tube. The outside diameter of the coil is equal to, or slightly less than, the inside diameter of the tube (in the case of a round tube) so that the wire or ribbon is placed against the wall surface or very close to it. When the flow of fluid trips over the wire, a high level of turbulence is generated in the boundary layer close to the wall surface, thus augmenting the heat transfer. Similarly, a helical coil can be put on the outside surface of the tube for augmentation of heat transfer at the outer surface when a fluid flows over the tube in the direction of the tube axis. Such helical coil-like turbulator is called a boundary layer turbulator. According to the method of this invention, the heat transfer coefficient inside the tube can be further increased when the boundary layer turbulator used inside the tube in conjunction with a spinner turbulator. Under this situation, centrifugal force due to circulatory motion of the bulk fluid helps to generate even higher levels of turbulence in the boundary layer extremely close to the wall and thus resulting in even higher levels of heat transfer augmentation. The application of such augmentation is only limited for the inside surface of the tube.

The ultimate object of the method of this invention is to apply a compound turbulator in an improved method of heat transfer in which the heat transfer surface of the heat exchange equipment can be significantly reduced. Thus, a significant savings can be obtained in fabricating this equipment. Such heat exchange equipment can exchange heat between any two fluids such as between a liquid and a liquid, or a gas and a liquid. The first fluid inside the heat exchange tube is highly turbulated, and thus substantially homogenous.

SUMMARY OF INVENTION

According to the method of transferring heat between a first fluid passing through the inside of a heat exchanger tube and a second fluid on the outside of the tube of the invention, the first fluid is passed over a compound turbulator disposed in the tube. The compound turbulator comprises a first boundary layer turbulator surrounding a spinner turbulator. The compound turbulator is a turbulence generator in the boundary layer very close to the tube wall surface. Such turbulence is generated by placing wire or ribbon (herein referred to as wire) on the wall surface or closely adjacent to the two wall surface in a direction perpendicular to the direction of the flow. When the flow of fluid trips over the wire, a very high level of turbulence is generated immediately downstream of the wire due to the flow separation that takes place as the fluid trips over the wire. Such boundary layer turbulence is primarily responsible for heat transfer augmentation at the wall surface. Such heat transfer augmentation is herein referred to as augmentation or enhancement of the convective heat transfer coefficient at the wall surface.

For tubular surfaces, heat transfer augmentation is achieved by placing a helical spring-like coil made of metal or non-metal wire or ribbon inside the tube to extend the length over which the augmentation is desired. The outside diameter of the coil (in case of a round tube) should be equal to or slightly less than the inside diameter of the tube so that the wire is placed against the wall surface or very closely adjacent to the wall. When a fluid flows through the tube, a high level of turbulence is generated in the boundary layer very close to the wall surface. Thus a high degree of heat transfer augmentation takes place for a given surface condition of the tube wall. The wire dimension; the number of turns per unit length (spacing of the wire); fluid flow characteristics such as velocity, density, and viscosity; and temperature are important parameters for the heat transfer augmentation. Therefore, the selection of parameters is important for achieving maximum augmentation for a given system. The heat transfer coefficient can be increased 2 to 5 times with a boundary layer turbulator.

Where the second fluid on the outside of the tube is also moving longitudinally with respect to the tube, an increase in heat transfer coefficient of the same order of magnitude can be achieved by simply slipping a boundary layer turbulator over the exterior of the tube. Here, the inside diameter of the coil is preferably the same as, or slightly larger than, the outside diameter of the tube such that the wire of the coil rests on the tube wall or very Closely adjacent to it.

According to the method of the present inventor, the heat transfer at the inside tube wall surface is further augmented through the provision of a compound turbulator made of a suitably dimensioned spinner turbulator surrounded by a boundary layer turbulator, placed inside the heat transfer tube. The wire or ribbon of the coil comprising the boundary layer turbulator rides on the spinner turbulator, and thus the spinner turbulator holds the boundary layer turbulator closely adjacent to the tube wall. The centrifugal force due to the circulatory motion of the bulk fluid drives the boundary layer turbulence into the laminar sub-layer zone extremely close to the wall surface and thus further increases the rate of heat transfer using a compound turbulator. The present invention can increase the heat transfer coefficient 3 to 8 times.

DESCRIPTION OF THE PREFERRED EMBODIMENTS OF THE INVENTION

Figure 1:
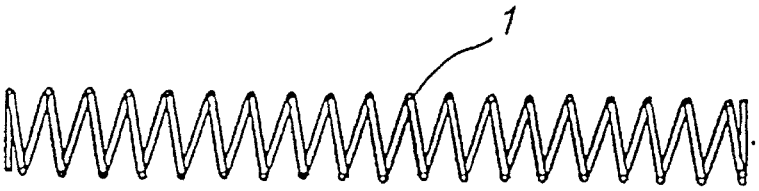
FIG. 1 is a side elevation view of a boundary layer turbulator.

FIG. 1 is a side elevation view of a boundary layer turbulator 1 in the form of a helical spring-like coil, adapted to incorporate into a compound turbulator according to this invention. The coil can be made of metal or nonmetal wire or ribbon. The dimension of coil is such that when it is placed inside the tube, the wire or ribbon is in contact with or closely adjacent to the wall. The dimension of the wire or ribbon, and the number of turns per unit length of coil has a strong effect on heat transfer augmentation for a given flow and tube size.

Figure 2:
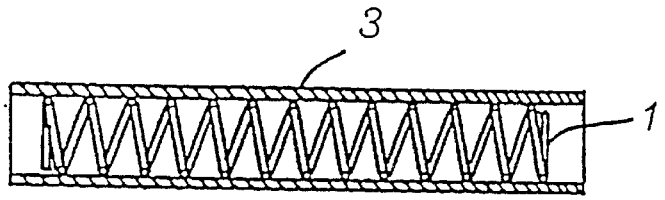
FIG. 2 is a longitudinal cross-sectional view of a table with a boundary layer turbulator installed inside.

FIG. 2 shows a boundary layer turbulator 1 installed inside a tube 3 increasing turbulence in a first fluid passing through the tube at the inside surface of the tube wall to increase heat transfer. The turbulator coil should extend over the length of the tube where heat transfer augmentation is desired. For easy installation and removal, the outside diameter of the turbulator coil is preferably slightly smaller than the inside diameter of the tube. The first fluid must flow through the tube in this configuration. The tube wall can be a smooth, rough, or extended surface.

Figure 3:
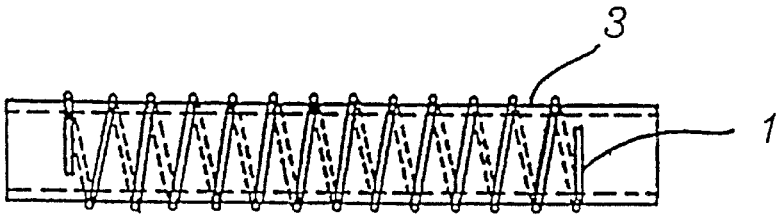
FIG. 3 is a side elevation view of a tube with boundary layer turbulator installed over the exterior.

FIG. 3 shows a boundary layer turbulator installed on the exterior surface of the tube 3 for increasing turbulence in the second fluid passing over the exterior of the tube at the exterior surface of the tube. For easy installation, the inside diameter of the turbulator coil is preferably slightly larger than the outer diameter of the tube. The turbulator coil should extend over the length of the tube where heat transfer augmentation is desired. The second fluid preferably flows longitudingly over the exterior of the tube, in a direction parallel to the tube's axis. The tube exterior can be a smooth, rough, or extended surface.

Figure 4:
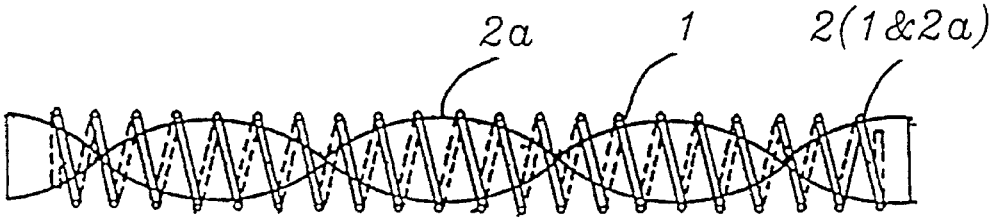
FIG. 4 is a side elevation view of a compound turbulator for use in the method of this invention, comprising a boundary layer turbulator surrounding a spinner turbulator.
Figure 5:
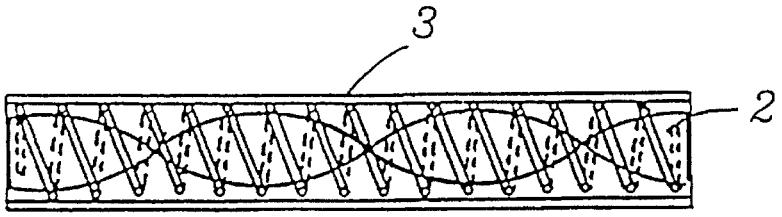
FIG. 5 is a longitudinal cross-sectional view of a tube with a compound turbulator installed inside.

FIG. 4 shows a compound turbulator consisting of the boundary layer turbulator 1 surrounding a spinner turbulator 2*a*. For easy installation, the width of the strip forming the spinner turbulator is preferably slightly less than inside diameter of the coil forming the boundary layer turbulator. This compound turbulator is far superior to a boundary layer Turbulator for heat transfer augmentation. The compound turbulator increases turbulence throughout the first fluid flowing through the tube, but it also offers more resistance to flow. This increased turbulence in the first fluid causes a thorough mixing of the first fluid, so that the first fluid passes through the tube as a thoroughly mixed, substantially homogenous fluid. FIG. 5 shows a compound turbulator 2 installed inside a tube 3.

Figure 6:
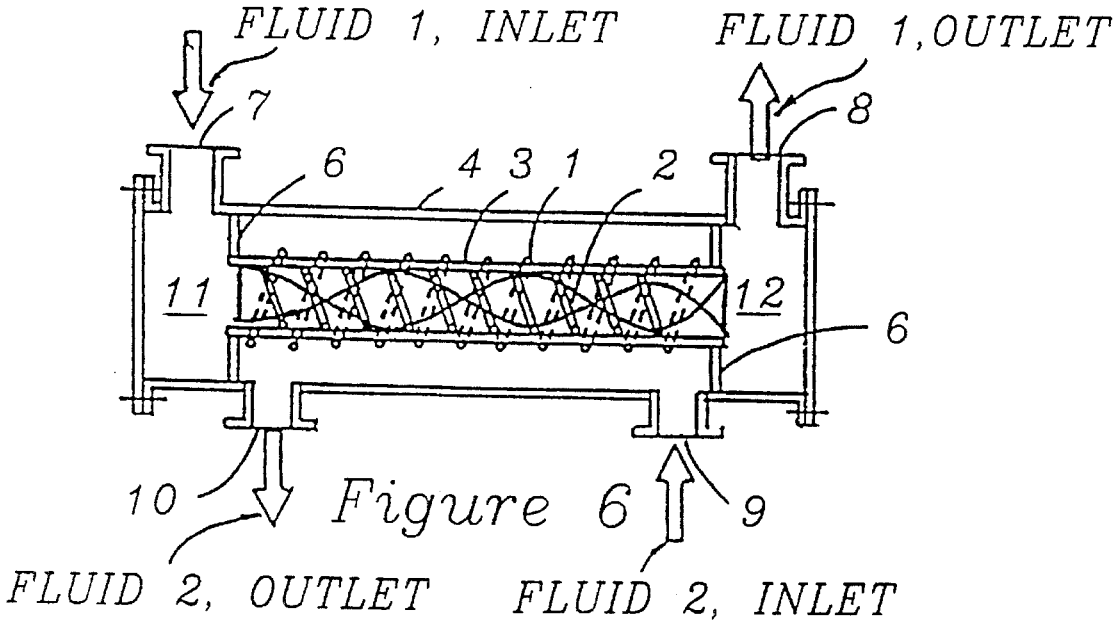
FIG. 6 is a schematic drawing showing a compound turbulator installed inside the tube and a boundary layer turbulator on the outside of the tube in a shell and tube heat exchanger.

FIG. 6 is a drawing of a typical shell and tube heat exchanger which consists of a shell 4 and two tube sheets 6. A heat exchanger tube (or tubes) 3 connects the two tube sheets as shown. Heat transfer at the inside tube surface is augmented by inserting a compound turbulator 2 inside the tube, and passing the first fluid over the compound turbulator. The first fluid enters through inlet 7 in plenum 11, flows through the tube 3 over the compound turbulator 2, into plenum 12, and then leaves the exchanger through outlet 8. The second participating fluid enters at one end into the shell at inlet 9 (for the counter flow situation as shown), flows over the tube 3 (which may have an external boundary layer turbulator thereon) exchanges heat, and finally leaves the exchanger at outlet 10. Because of the increased turbulence in the first fluid caused by passing the first fluid over the compound turbulator this method effectively enhances heat transfer. Therefore, the number of tubes, and size of the exchanger, can be reduced without sacrificing the thermal performance of the equipment. A multi-tube exchanger can be designed and constructed to fulfill the requirements for a wide range of applications. The compound turbulator 2 is useful for further augmentation at the tube's inside surface in heat exchangers transferring heat between (a) liquid and liquid, (b) liquid and gas, and (c) gas and gas.

Figure 7:
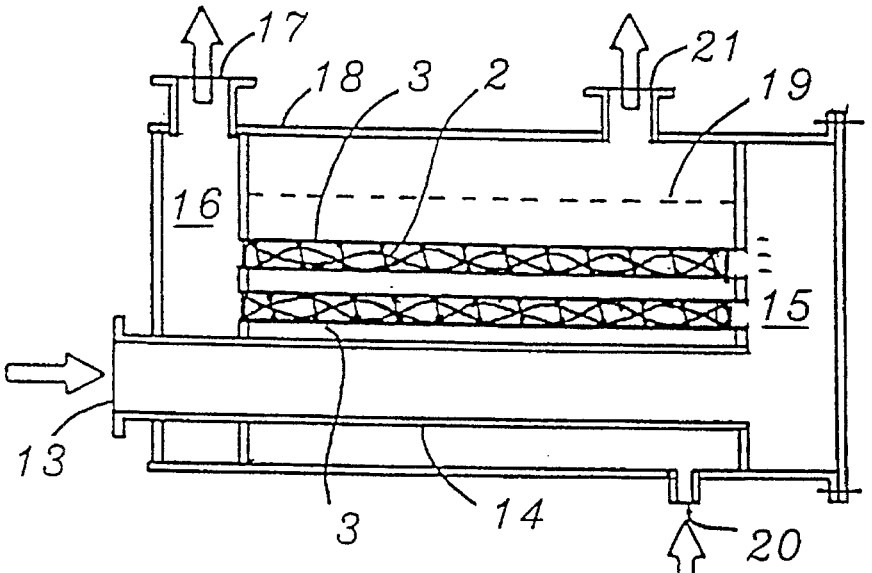
FIG. 7 is a schematic view of a compound turbulator in a fired or unfired firetube boiler.

FIG. 7 is a schematic drawing of a two-pass firetube fired or unfired boiler which consists of a shell 18, a furnace tube 14 (optional for unfired boiler), and flue tubes 3. A burner for a fired boiler is mounted at 13 or a hot gas supply for unfired boiler is connected at 13. Thus, hot gas flows through furnace tube 14 in plenum 15, and then flows through the flue tubes 3 into plenum 16, and finally leaves the boiler at outlet 17. The water level inside the boiler is maintained at level 19 so that the furnace tube and all flue tubes are always immersed in water completely. Water is fed into the boiler at inlet 20 and steam leaves the boiler at outlet 21. Compound heat transfer according to the method of this invention is achieved by placing compound turbulator 2 inside the flue tubes 3. A typical boiler has a large number of flue tubes. Therefore, increasing heat transfer can reduce the required number of flue tubes and overall size of the boiler significantly, thereby reducing the cost. Also, in an existing boiler, the use of compound turbulators improves the thermal performance significantly and the savings involved justifies the cost of installation of these types of turbulators.

What is claimed is:

1. An improved method of heat transfer between a first fluid passing through the inside of a heat exchange tube, and a second fluid on the outside of the heat exchange tube, the improvement comprising: passing the first fluid through a compound turbulator inside the tube, the compound turbulator comprising a twisted strip surrounded by a helical coil that is either in contact with or closely spaced from the walls of the tube, to generate a high level of turbulence in the first fluid in the region adjacent the tube wall to facilitate heat transfer to the second fluid on the outside of the heat exchange tube.

2. An improved method of heat transfer according to claim 1 wherein this is a closely fitted helical coil on the outside of the heat exchange tube, and further comprising the step of forcing the second fluid to flow longitudinally along the outside of the tube over the helical coil, to generate a high degree of turbulence in the second fluid adjacent the outside surface of the tube.

3. An improved method of heat transfer between a first substantially homogenous fluid passing through the inside of a heat exchange tube, and a second fluid on the outside of the heat exchange tube, the improvement comprising: passing the first substantially homogeneous fluid through a compound turbulator inside the tube, the compound turbulator comprising a twisted strip surrounded by a helical coil that is either in contact with or closely spaced from the walls of the tube, to generate a high level of turbulence in the first substantially homogeneous fluid in the region adjacent the tube wall to facilitate heat transfer to the second fluid on the outside of the heat exchange tube.

4. An improved method of heat transfer according to claim 3 wherein this is a closely fitted helical coil on the outside of the heat exchange tube, and further comprising the step of forcing the second fluid to flow longitudinally along the outside of the tube over the helical coil, to generate a high degree of turbulence in the second fluid adjacent the outside surface of the tube.

5. A compound turbulator for heat transfer enhancement for use in combination with a heat exchanger tube, the compound turbulator comprising:

a twisted strip within a helical coil, wherein the compound turbulator is installed coaxially inside a tube of a heat exchanger, and the helical coil being either in contact with or closely spaced from an inner tube wall surface.

6. A compound turbulator described in claim 5 in combination with a helical coil turbulator, wherein the helical coil turbulator installed on or closely spaced from an outer surface of the heat exchanger tube enhances the heat transfer of the heat exchanger tube.

7. A compound turbulator described in claim 5 wherein the helical coil of the compound turbulator comprises a coiled ribbon.

8. A compound turbulator described in claim 5 wherein the helical coil of the compound turbulator comprises a coiled wire.

9. A compound turbulator described in claim 6 wherein the outer helical coil turbulator spring comprises a coiled ribbon.

10. A compound turbulator described in claim 6 wherein the outer helical coil turbulator comprises a coiled wire.

* * * * *